US006315317B1

(12) United States Patent
Liard et al.

(10) Patent No.: US 6,315,317 B1
(45) Date of Patent: Nov. 13, 2001

(54) BOARD FOR GLIDING

(75) Inventors: Jean Liard; Jean-Pierre Ract, both of Sallanches; Christophe Bressand, Les Houches, all of (FR)

(73) Assignee: Skis Dynastar, Sallanches (FR)

( * ) Notice: Subject to any disclaimer, the term of this patent is extended or adjusted under 35 U.S.C. 154(b) by 0 days.

(21) Appl. No.: 09/470,506

(22) Filed: Dec. 22, 1999

(30) Foreign Application Priority Data

Dec. 23, 1998 (FR) ..... 98 16514

(51) Int. Cl.[7] ..... A63C 5/04
(52) U.S. Cl. ..... 280/607; 280/609
(58) Field of Search ..... 280/602, 607, 280/609, 610, 636, 617

(56) References Cited

U.S. PATENT DOCUMENTS 2,196,925 * 4/1940 Kairis ..... 280/607
3,907,315 * 9/1975 Charneck ..... 280/609
3,926,451 * 12/1975 Guild ..... 280/609
4,007,946 * 2/1977 Sarver ..... 280/607 X
4,804,200 * 2/1989 Kachler ..... 280/609 X
5,346,244 * 9/1994 Le Masson ..... 280/607
5,366,234 * 11/1994 Rohrmoser ..... 280/609 X
5,427,401 * 6/1995 Liard ..... 280/609

FOREIGN PATENT DOCUMENTS

3933717 * 12/1990 (DE) ..... 280/602
0 753 330 A 1 7/1966 (EP) .
2 718 650 4/1994 (FR) .

* cited by examiner

*Primary Examiner*—Michael Mar
(74) *Attorney, Agent, or Firm*—Wall Marjama & Bilinski

(57) ABSTRACT

A board for gliding has an upper face which includes a zone for fitting the binding. The fitting zone is centered with respect to the point for fitting the mid-point of the boot, and receives the toe stop of a binding in its front portion and the heel binding in its rear portion. The board includes a step between the front portion of the fitting zone and the rear portion of the fitting zone, and is modified such that gliding board at the front portion of the fitting zone is thicker than the gliding board at the rear portion of the fitting zone.

9 Claims, 5 Drawing Sheets

BOARD FOR GLIDING

FIELD OF INVENTION

The invention relates to the field of winter sports. It relates more precisely to a ski having a new shape allowing it to run better, particularly as regards the transmission of loads.

BACKGROUND OF THE INVENTION

As is known, when taking part in alpine skiing, the skier's boot is held securely with respect to the board by means of a safety binding composed of a toe stop located at the front of the boot and a heel binding holding the heel. The bindings are located on the ski in a zone defined normally as the "binding-fitting zone". This zone is centered with respect to the point of fitting the boot corresponding to the boot's mid-point. Its length is between 30% and 50% of the bearing length of the ski as a function of the size of the ski.

Many skis are sharply waisted and are thus relatively narrow in the median zone corresponding to the zone for fitting the binding.

Due to this narrowness the boot comes into contact with the snow when the ski is sharply tilted during turning stages. To solve this problem, it has been proposed to equip skis with a raised platform on which the two toe-stop and heel-binding parts of the binding are fitted.

Examples of such platforms are described particularly in documents FR 2 105 801, U.S. Pat. No. 3,260,532 and FR 2 409 776.

These platforms present a number of drawbacks, including, inter alia, their weight and their cost. The platforms stiffen the skis and result in a loss of energy at a time when momentum is required for turning. This loss is due to the stacking of mechanical components, the different mechanical clearances and flexions in the suspended parts.

In the initial stage of a turn, the skier exerts forces essentially at the front of the binding. When the momentum is required, these loads are transmitted by the board as far as the snow at the edges of the skis and, more precisely, onto the edges on the inside of the turn.

Thus, at the time of this momentum, the ski deforms and, more precisely, bends principally in flexion.

It is important for the ski to retain its inherent deformation characteristics even when it is equipped with safety bindings and the skier's boot. The ski's tendency to deform affects its behavior, i.e. its precision, grip, speed, comfort, etc. It is directly linked to the intensity and direction of the forces exerted on the ski by the skier. Deformation of the ski depends on the inner structure of the ski and its geometry, particularly its profile and variation in thickness, each ski preferably being designed for a specific type of use: long turns, short turns, powder, etc.

It is thus important not to unduly disrupt the behavior of a ski by equipping it with rigid devices such as bindings and platforms.

Moreover, when momentum is exerted on the ski, a deformation is propagated along the structure of the ski as a function of the board's inherent stiffness. The propagation of this deformation, equivalent to a vibration of the board, gives rise, in the zone of contact between the ski and the snow, i.e. the edges, to an oscillatory variation in the contact pressure.

In practice, this translates into jolting in the bearing zone, commonly known as "chattering", which disrupts the behavior of the turn and thus the precision of the ski which itself affects skier safety.

SUMMARY OF THE INVENTION

The invention thus relates to a board for gliding, the upper face of which includes a zone for fitting the binding, which is centered with respect to the point for fitting the mid-point of the boot, intended to receive:

in its front portion, the toe stop of a binding;

in its rear portion, the heel binding of a binding.

This board for gliding is noteworthy in that it includes a step between the front portion of the zone for fitting the binding and the rear portion of the zone for fitting the binding, in such a manner that the thickness of the board for gliding in the front portion of the zone for fitting the binding is greater than the thickness of the board for gliding in the rear portion of the zone for fitting the binding.

In other words, the invention consists in giving the board for gliding a particular shape in which the front part, on which the toe stop of the binding is fitted, is raised relative to the rear part. This front part is separated from the rear part of the zone for fitting the binding by a marked difference in level. Step is understood to mean a significant difference in height, embodied by a gradient equivalent to at least 20%.

This excess thickness is present in the zone of the ski which experiences maximum loads, typically corresponding to the momentum forces at the front of the boots of the order of 200 daN to 500 daN. It guarantees advantageous load distribution, improved resistance to deformation of the ski and allows, as a function of the chosen inner structure, either better damping of the vibrations or more efficient transmission of the forces, making the ski more responsive.

In this front zone in which the thickness of the board is greater than that of the board in the rear zone, transmission of the forces over the front of the ski is more widely distributed, thus resulting in a ski which bears more on the snow without penalizing the ability of the rear of the ski to bend in flexion.

This zone of greater thickness limits the deformations and, in particular, the ski's bending in flexion at the active part when commencing the turn, which translates into longer-lasting and thus more effective bearing of the edges on the snow.

Moreover, this excess-thickness zone gives the board rigidity and additional stiffness, which translates into a reduction in the board's capacity to start oscillating and thus a gain in precision when starting and carrying out the turn, in other words greater attenuation of the "chattering" phenomena.

In a particular embodiment, the difference in the thicknesses of the board in the front and rear portions, respectively, of the zone for fitting the binding is between 3 and 30 mm.

Indeed, it has been observed that, when the difference in the thicknesses was less than the aforesaid value, it is difficult for the user to perceive the influence of the raising zone on the ski's behavior, whereas when this difference is in excess of 30 mm, the overall stiffness of the board is modified to too great an extent and generates additional disruptions such as fragility or excess flexibility of the ends.

In one embodiment, the thickness of the board decreases continuously from the front of the front zone of the zone for fitting the binding as far as the front contact line.

In one of such cases, the profile of the ski has a slight gradient descending from the location of the toe stop of the binding as far as the front contact line. This embodiment is particularly advantageous for forming the inner reinforcement located below the upper face forming the graphics. The portion located at the rear of the zone for fitting the binding has a maximum thickness which is less than that of the front zone, which decreases as a slight gradient and without interruption as far as the rear zone of the ski or heel. These two opposing slight-gradient profiles are separated by the characteristic step.

In another advantageous embodiment, the raised zone is also limited toward the front by a second step.

In other words, in this case, the board for gliding has a protuberance formed on the top of the board, at the front of the zone for fitting the bindings, the raising zone being delimited not only at the rear but also at the front by steps. At the front and at the rear of these steps, the ski resembles a conventional ski.

In one embodiment, the front portion of the zone for fitting the binding, having a thickness greater than the rear of the zone for fitting the binding, extends over a length of between 150 and 350 mm.

The greater part of this protuberance is located at the front of the point embodied on the ski as corresponding to the "boot mid-point".

In this case, the upper surface of the ski has a protuberance allowing stiffening of the ski in order to obtain the desired pressure distribution over the snow.

According to a number of variant embodiments, the protuberance may extend transversely over all or part of the width of the board for gliding.

If the protuberance extends over only a part of the width of the board for gliding, this protuberance may consist of a single part located substantially at the mid-point of the width of the board or of several parts located at least at the sides of the board.

BRIEF DESCRIPTION OF THE DRAWINGS

The manner of implementing the invention and the advantages arising therefrom will become clearly apparent from the following description of the embodiments, with the support of the appended figures, in which.

DETAILED DESCRIPTION OF THE INVENTION

Figure 1:
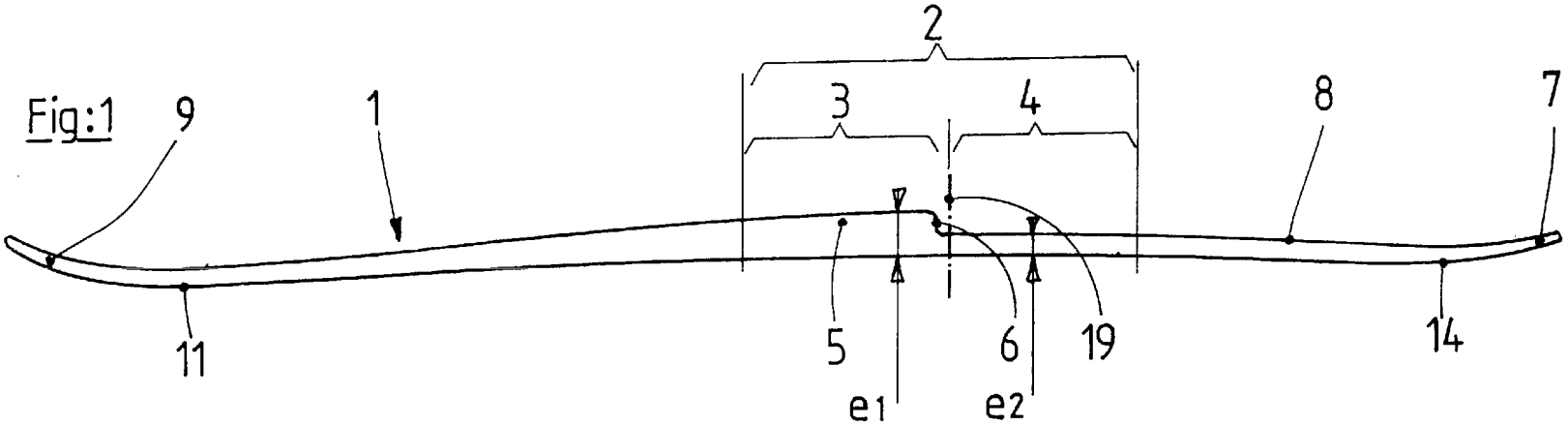
FIG. 1 is a side view of a ski according to a first embodiment.

As already stated, the invention relates to a particular board for gliding having a new configuration. Thus, in a known manner, a board for gliding (1) comprises, at the front, a tip (9), at the rear a heel (7), a front contact, line (11) and a rear contact line (14), and a zone (2) for fitting the binding defined in a normal manner.

This zone (2) for fitting the binding is broken down into two parts separated by a "boot mid-point" mark (19), namely a front portion (3) intended for receiving the toe stop of the binding and a rear portion (4) intended for receiving the heel binding of a binding.

According to a characteristic of the invention, this zone for fitting the bindings has a step between the front portion (3) of the zone (2) for fitting the binding and the rear portion (4) of this same zone (2).

This particular form gives the board for gliding, in the front portion (3) of the zone for fitting the binding, a thickness ($e_1$) which is markedly greater than the thickness ($e_2$) measured in the rear portion (4) of the zone (2) for fitting the binding. Thus, a board of this type has, inside the zone (2) for fitting the binding, a step (6) embodying the rear limit of the protuberance (5).

In practice, the difference in thickness of the ski between the front portion (3) and the rear portion of the zone (2) for fixing the binding may be between 3 and 30 mm, and preferably in the region of 10 mm.

Thus, on a board of this type, the zone (3) located under the toe stop of the binding corresponding to the zone of application of the momentum force of the skier when initiating and carrying out the turn is thicker and thus provides localized stiffening of the ski. Conversely, the rear of this zone has a conventional thickness because it is loaded less during this stage of the turn.

In order to allow the binding to be fitted, the heel binding is fitted either on a raising wedge or on a platform which is itself secured to the protuberance (5), extending rearward.

The thickness of the rear part of the ski will thus conventionally decrease, for example from a thickness of 18 mm in the rear zone for fitting the binding down to a thickness of 7 mm at the heel (7) of the ski.

Figure 3:
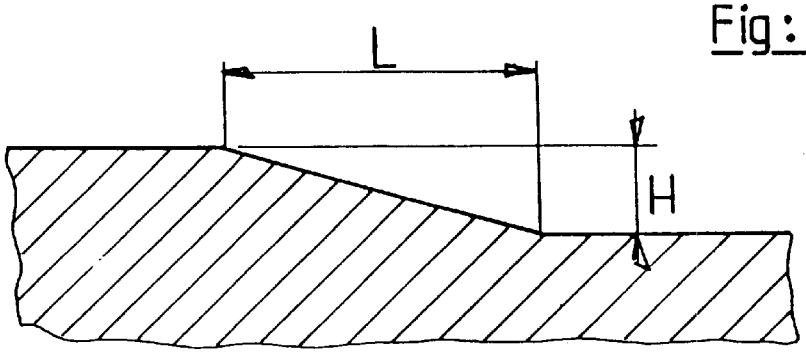
FIGS. 3, 4 and 5 are partial side views of skis produced according to the invention, illustrating the step to the rear of the protuberance according to the invention.

FIG. 3 makes it possible to define the specific step of the invention. To avoid increasing the height of the ski over too great a length, which would result in it being heavier and made excessively rigid, the specific ski of the invention includes a relatively sudden difference in height, located in the zone for fitting the binding, practically in the zone of the boot mid-point (19).

This step, with a height H and a length L, has a gradient H/L in excess of 0% (twenty percent).

Figure 4:
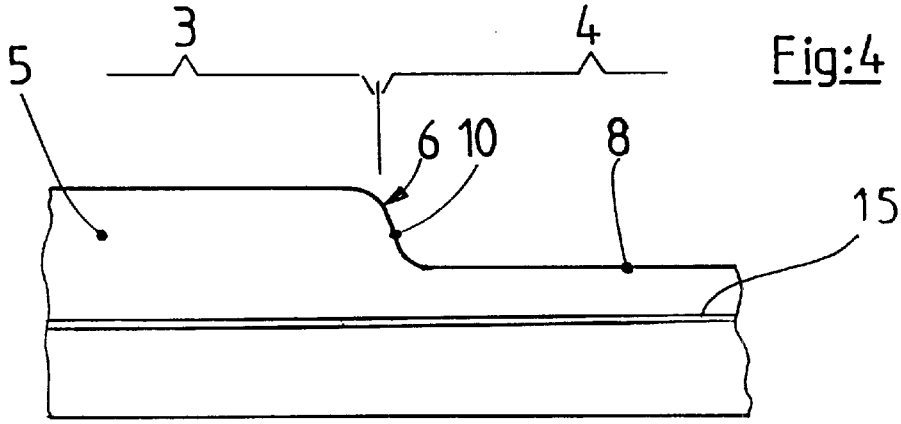
Figure 5:
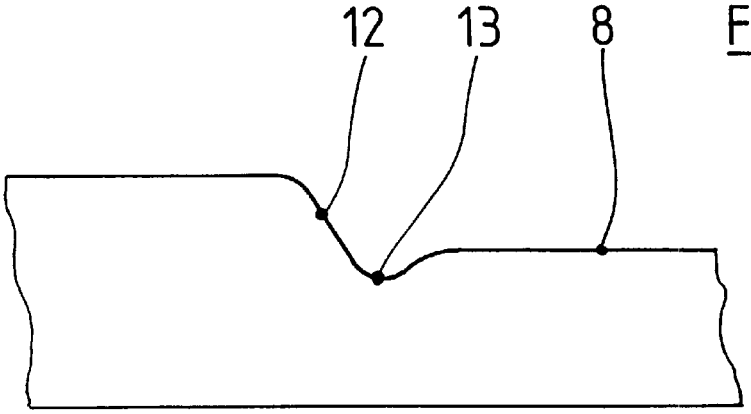

The profile of the step (6) may vary widely, as illustrated, for example, in FIGS. 4 and 5.

Thus, as illustrated in FIG. 4, the step (6) limiting the rear of the protuberance (5) may consist of an inclined section (10), the gradient of which relative to the upper surface (8) of the rear zone for fitting the bindings of the ski may be optimized as a function of the inner structure of the board.

As may be observed in FIG. 4, the board may include in its inner structure an insert (15) intended to facilitate attachment of the screws of the binding, or an optional raising platform, and to increase the value of the thread torque likely to give rise to deterioration of the thread of the screw or of the latter's threading.

This insert (15) may consist of a plate of a variety of materials, such as, for example, laminates impregnated with phenolic resin or melamine, plates made from acrylonitrile butadiene styrene (ABS) or, alternatively, laminated plates of glass fibers combined with an epoxy resin.

An insert (15) of this type has a planar geometry which means, as may be seen from FIG. 4, that its distance to the upper face of the board is variable. More precisely, this distance is greater in the zone (3) of the protuberance whereas it is relatively small in the region (4) corresponding to the thinnest zone of the board.

An insert (15) of this type may have a length in the region of 550 mm, a width of 55 mm and a thickness of the order of 1 to 2 mm.

Other profiles may be envisaged, such as that illustrated in FIG. 5, in which the step (12) extends beyond the thickness of the board for gliding in the rear part (4) of the zone for fitting the binding, forming a zone with a hollow (13).

As already stated, the board for gliding according to the invention is thicker in the front part of the zone for fitting the binding.

The protuberance (5) having an additional thickness may extend, as illustrated in FIG. 1, as far as the front of the ski, with a continuous decrease in the thickness of the ski along the protuberance (5).

Figure 2:
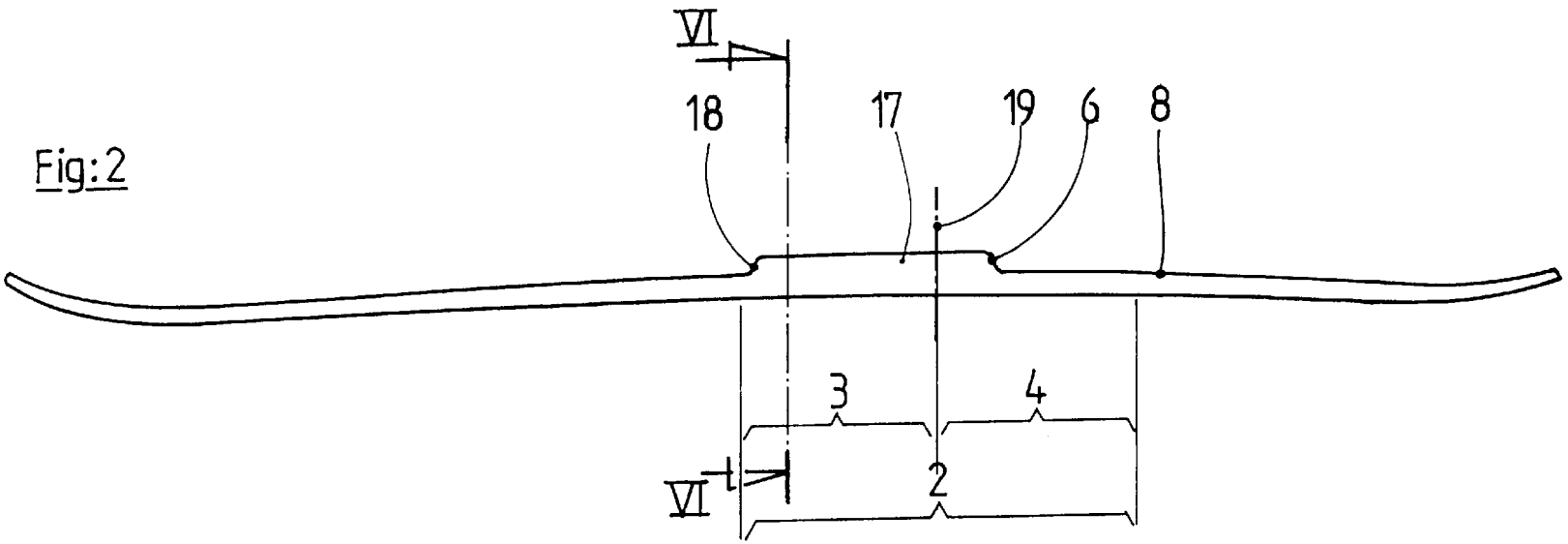
FIG. 2 is a side view of a ski according to a second embodiment.

In the embodiment illustrated in FIG. 2, the protuberance (17) is short and limited at the front by a second step (18). In other words, the protuberance (17) is located on solely a fraction of the front of the zone for fitting the bindings of the ski.

Typically, the length of this protuberance is between 150 and 350 mm.

In order to carry out its function, the protuberance (17) as illustrated in FIG. 2 may be present over all or part of the width of the ski.

Figure 6:
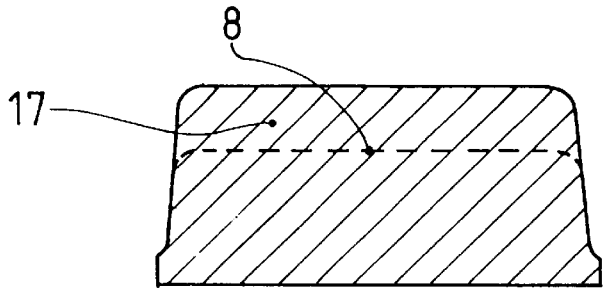
FIGS. 6 to 8 are summary transverse sectional views along VI—VI in FIG. 2 at the level of the characteristic protuberance of skis produced according to three different embodiments.

Thus, as illustrated in FIG. 6, which represents a summary section VI–VI' of FIG. 2, this protuberance (17) is present over the entire width of the ski.

Figure 7:
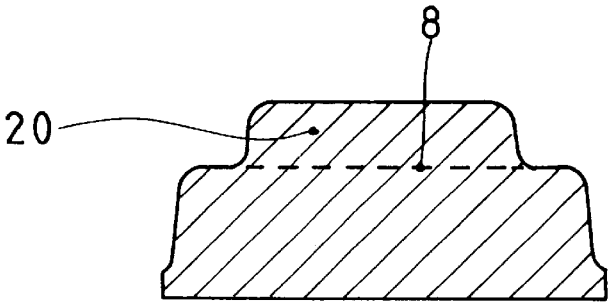

In other variants, such as, in particular, that illustrated in FIG. 7, the protuberance (20) extends transversely solely over a central part of the width of the ski.

The width of this protuberance (20) may be adapted as a function of the desired stiffness characteristics and the position for fitting the toe stop of the binding.

Figure 8:
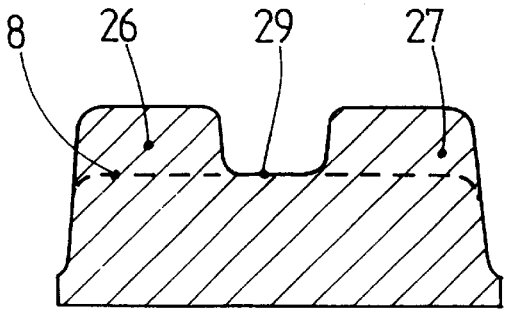

In another variant embodiment, illustrated in FIG. 8, this protuberance is broken down into two protuberances (26, 27) extending from the lateral zones of the ski toward the median plane. In this way, the ski has a zone with a hollow (29), the width of which may be variable over the length of the protuberance.

Figure 9:
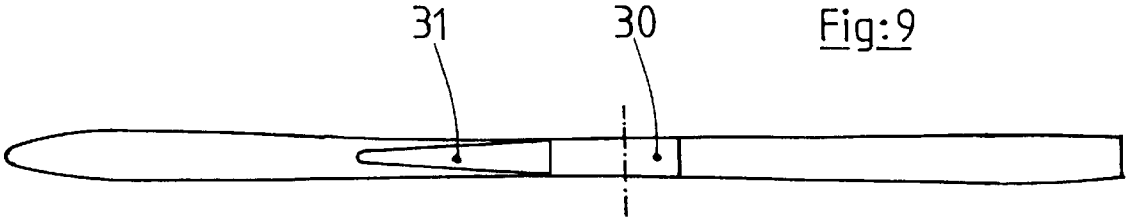
FIG. 9 is a top view of a ski produced according to a variant embodiment.

In an advantageous form illustrated in FIG. 9, the protuberance (30) is present over the entire width of the board in the front part of the zone for fitting the binding. It extends forward in order to form a rib (31), the width and height of which diminish toward the tip.

FIGS. 10 to 16 illustrate the inner core of a ski produced according to a variant embodiment of the invention.

Figures 10, 11, 12:
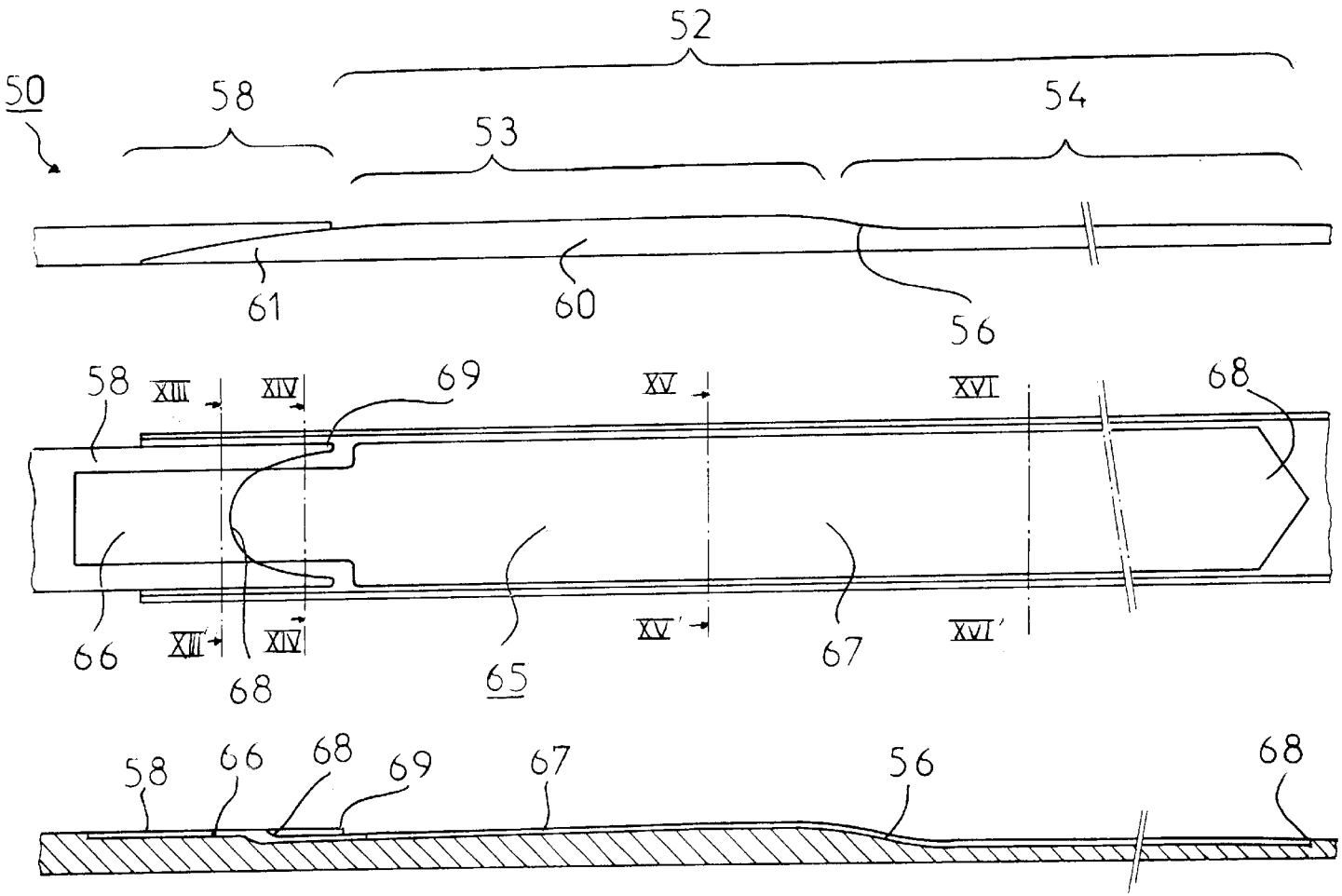
FIG. 10 is a partial top view, in the zone of the characteristic protuberance, of the inner core of a ski produced according to another variant of the invention.
FIG. 11 is a side view of the core illustrated in FIG. 10.
FIG. 12 is a median longitudinal sectional view of the core of FIG. 10.
Figure 13:
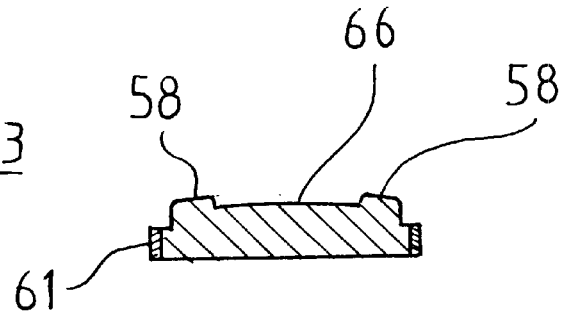
FIG. 13 is a transverse sectional view of the core of FIG. 10 in the plane XIII—XIII.

Thus, according to this variant and as may be observed in FIG. 11, the ski comprises a core (50) which is characterized in that it includes a zone (52) for fitting the binding which consists of two portions, namely a thinner rear portion (54) and a thicker front portion (53), these two portions being separated by a step (56).

In the variant embodiment illustrated, the front portion (53) extends via. an even thicker zone (58) extending over some tens of centimeters beyond the position of the toe stop of the binding.

In this embodiment, the sides of the board include visible portions (60) of the core, which are flush with the sides.

In the example illustrated, the core (50) is visible on the sides in the running zone and is covered by the protective upper layer of the shell of the ski in front of the running zone.

The height of the visible side (60) of the core decreases progressively in the zone of the join (61) between the runner part and the front of the ski.

The element forming the visible side part (60) of the core may consist of multiple materials, for example laminates of phenolic resin, melamine resin or, alternatively, thermoplastic materials such as acrylonitrile butadiene styrene (ABS).

As may be observed in FIG. 10, the upper face of the core comprises a recess (65) intended for receiving a local reinforcement having the form of a sheet. This sheet may, in particular, consist of a glass-fiber fabric impregnated with epoxy resin.

As illustrated in FIG. 10, this local reinforcement and thus the corresponding recess may have an elongate shape formed by the combination of two principally rectangular zones, namely a first front zone (66) covering approximately 80% of the width of the core and a rear zone (67) covering practically all the width of the core.

The rear zone (67) of this local reinforcement extends over practically all the zone for fitting the binding and may end, by way of example, in a triangular zone (68) or, alternatively, in any other shape which is advantageous in improving the strength of the board for gliding.

Figure 15:
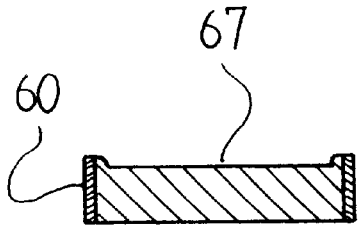
FIG. 15 is a sectional view of FIG. 10 in the plane XV—XV.
Figure 16:
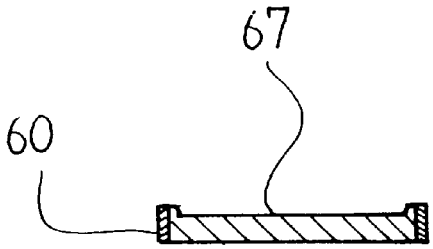
FIG. 16 is a sectional view of FIG. 10 in the plane XVI—XVI.

As may be observed in FIGS. 15 and 16, the local reinforcement and thus the corresponding recess (67) is bordered at the side by the presence of the portions (60) forming the visible sides, in such a manner that when the reinforcement is in position in the recess its upper surface is at the same level as the top of the visible side elements, and so that the core thus has a rectangular section.

At the front of the zone for fitting the bindings, as already stated, the board and the core include an excess-thickness zone (58) which has a rear end (68) of curved shape.

Figure 14:
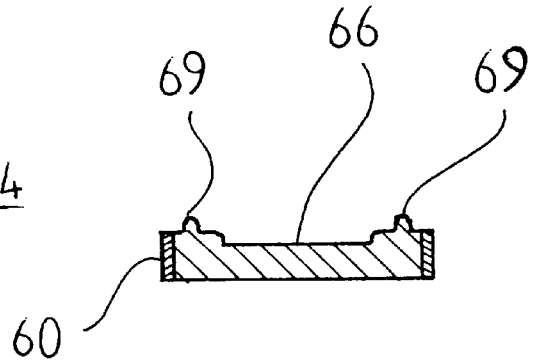
FIG. 14 is a sectional view of FIG. 10 in the plane XIV—XIV.

This excess thickness (58) extends laterally and rearward in two ribs (69) which may be observed in FIGS. 10 and 14. These ribs are capable of enclosing the front end of a plate or of a platform intended for receiving the actual binding.

It emerges from the above that the board for gliding according to the invention has a particular geometry ensuring, in particular, very good transmission of loads when starting a turn. Moreover, a reduction in the influence of vibrations and more effective performance in terms of force transmission are observed. However, the structure of the board allows raising of the toe stop of the binding without an intermediate component. Finally, stiffness distribution offset toward the front of the ski is observed.

What is claimed is:

1. A board for gliding, the board being configured for the attachment of a binding assembly which includes a toe binding and a heel binding, the board comprising: an integrally formed member having a top surface and a bottom surface, the top surface including a zone for fitting the binding assembly thereto, the zone being divided into longitudinally spaced front and rear portions which are joined by a step portion extending therebetween, the toe binding adapted to be mounted to the top surface of the front portion and the heel binding adapted to be mounted to the top surface of the rear portion, wherein a thickness of the board measured between the top and bottom surfaces along the front portion of the zone being greater than a thickness of the board measured between the top and bottom surfaces along the rear portion of the zone to provide the front portion with a top surface which is higher than the top surface of the rear portion, a ratio of a vertical height of the step portion to a longitudinal length of the step portion exceeds 20 percent, and the longitudinal length of the front and rear portions being substantially equal.

2. The board for gliding as claimed in claim 1, wherein the front portion (3) of the zone (2) for fitting the binding forms a protuberance (17) limited at a forwardmost end by a second step (18).

3. The board for gliding as claimed in claim 2, wherein the protuberance (17) extends over a length of between 150 and 350 mm.

4. The board for gliding as claimed in claim 2, wherein the protuberance (17) extends transversely over an entire upper width of the board for gliding.

5. The board for gliding as claimed in claim 2, wherein the protuberance (17) extends transversely over a part of the width of the board for gliding.

6. The board for gliding as claimed in claim 4, wherein the thickness ($e_1$) of the board for gliding decreases continuously from the front portion (3) of the zone for fitting the binding to as far as a front contact zone (11) of the ski.

7. The board for gliding as claimed in claim 1, wherein the thickness ($e_1$) of the board for gliding in the front portion (3) of the zone (2) for fitting the binding is constant.

8. The board for gliding as claimed in claim 7, wherein the thickness ($e_1$) of the board for gliding decreases continuously from the front portion (3) of the zone for fitting the bindidng to as far as a front contact zone (11) of the ski.

9. The board for gliding as claimed in claim 8, wherein the protuberance (20) is located transversely at a mid-point of the board.

* * * * *